US007922268B2

(12) United States Patent
Weber

(10) Patent No.: US 7,922,268 B2
(45) Date of Patent: Apr. 12, 2011

(54) CUPBOARD INSTALLATION PART WITH STORAGE COMPARTMENTS, WHICH PART IS INSERTABLE IN AN UPPER CUPBOARD

(75) Inventor: Peter Weber, Beinwil am See (CH)

(73) Assignee: Peka-Metall AG, Mosen (CH)

( * ) Notice: Subject to any disclaimer, the term of this patent is extended or adjusted under 35 U.S.C. 154(b) by 441 days.

(21) Appl. No.: 12/126,525

(22) Filed: May 23, 2008

(65) Prior Publication Data

US 2009/0289535 A1 Nov. 26, 2009

(51) Int. Cl.
*A47F 5/08* (2006.01)

(52) U.S. Cl. ..... 312/246

(58) Field of Classification Search ..... 312/245, 312/246, 247, 248, 319.1, 319.2, 319.3, 319.5, 312/325, 27, 30, 266; 211/115, 116
See application file for complete search history.

(56) References Cited

U.S. PATENT DOCUMENTS 4,915,461 A * 4/1990 Kingsborough et al. ..... 312/247
5,228,763 A * 7/1993 Gingold ..... 312/266
5,249,858 A * 10/1993 Nusser ..... 312/319.6
5,308,158 A * 5/1994 Vogelgesang et al. ..... 312/319.3
5,857,756 A * 1/1999 Fehre ..... 312/246
5,934,615 A * 8/1999 Treichler et al. ..... 244/118.5

FOREIGN PATENT DOCUMENTS

DE 10002296 * 7/2001
EP 1880636 A1 1/2008

* cited by examiner

*Primary Examiner* — James O Hansen
(74) *Attorney, Agent, or Firm* — Pearne & Gordon LLP

(57) ABSTRACT

A cupboard installation part with storage compartments is insertable in an upper cupboard and is pivotable from an upper position, moved into the upper cupboard, into a position moved out of the upper cupboard and displaced downward. The cupboard installation part comprises pivot levers aligned parallel, which, on the one hand, are coupled to the cupboard installation part, and, on the other hand, are able to be coupled to the upper cupboard. A supporting element is insertable and mountable in the upper cupboard, on which supporting element a first pivot lever and a second pivot lever are pivotably borne, in each case in a first pivot bearing. The two pivot levers are each pivotably connected to a support part via a second pivot bearing, on which support part the storage compartments are mountable, at least on one side. An easily mountable cupboard installation part is thereby obtained which has a very stable construction and is usable in diverse ways.

10 Claims, 7 Drawing Sheets

CUPBOARD INSTALLATION PART WITH STORAGE COMPARTMENTS, WHICH PART IS INSERTABLE IN AN UPPER CUPBOARD

The present invention relates to a cupboard installation part with storage compartments, which part is insertable in an upper cupboard and is pivotable from an upper position, moved into the upper cupboard, into a position moved out of the upper cupboard and displaced downward, for which purpose the cupboard installation part comprises pivot levers, aligned parallel, which, on the one hand, are coupled to the cupboard installation part, and, on the other hand, are able to be coupled to the upper cupboard.

Such cupboard installation parts are known. With today's kitchen facilities one strives to use the available space as optimally as possible. Thus upper cupboards are also used that often extend to the ceiling; accessibility in the upper region of these upper cupboards is not possible for a person of normal height without a climbing aid. These cupboard installation parts allow themselves to be pivoted from an upper position, moved into the upper cupboard, into a position moved out of the upper cupboard and displaced downward, whereby the accessibility to the storage compartments contained in this cupboard installation part is ensured at a comfortable working height.

These known cupboard installation parts with storage compartments are usually held in the upper cupboard by two pivot lever pairs each. One pivot lever pair in each case is hereby disposed on both sides of the cupboard installation part, for which purpose the latter is provided with lateral walls. In order to be able to ensure a parallel pivoting down of this cupboard installation part out of the upper cupboard and pivoting up of this cupboard installation part into the upper cupboard, these two lateral walls must be connected to one another in a warp-resistant way, which calls for use of rigid connecting elements, which is complex. Moreover, during installation of this cupboard installation part in the upper cupboard, it is necessary for the mounts for the pivot lever pairs to be fixed on both sides of the upper cupboard, which also makes assembly time-consuming.

The object of the present invention thus consists in creating a cupboard installation part with storage compartments which is of simple construction and which can be mounted in the respective upper cupboard with little effort.

This object is achieved according to the invention in that the cupboard installation part comprises a supporting element, which is insertable and mountable substantially vertically in the upper cupboard in a central region, on which supporting element a first pivot lever and a second pivot lever are each pivotably borne in a first pivot bearing, and a support part, which is pivotably connected to the first and second pivot lever, in each case via a second pivot bearing, on which support part the storage compartments are mountable on both sides.

Through the design of the invention with just one pivot lever pair, the supporting element, to which these pivot levers are coupled, can be attached as desired on the one side or the other side or in the central region of this upper cupboard, which can take place through a simple mounting; depending upon the position of this supporting element in the upper cupboard, storage compartments can then be mounted on the support part on one side or on both sides. A diversity of application possibilities is thereby obtained; the width of the upper cupboard can be completely made use of through the suitable selection of width of the storage compartments. The construction bearing the storage compartments remains the same for each case of application.

Preferably, the supporting element has a rod-shaped support that is provided on one side with a fastening plate, into which support a section is telescopically insertable on the other side, on the exterior end of which a fastening plate is also disposed, and which section is fixable in any position with respect to the rod-shaped support. The supporting element thereby allows itself to be adapted to different structural heights of an upper cupboard. The attachment is very simple; through the configuration of the fastening plates, the supporting element can be attached to the floor and to the upper faceplate of the upper cupboard. The attachment of this supporting element thus takes place independently of the rear wall of the upper cupboard, which is often formed by a cover that is not stable or is even omitted altogether.

Preferably, two first plates, aligned parallel to one another, are disposed on the rod-shaped support, between which two first plates the first pivot lever and the second pivot lever are disposed, and the first pivot lever and the second pivot lever are formed by hollow sections. Through this design a very stable bearing of the pivot lever on the supporting element is obtained. In addition, the first pivot lever and the second pivot lever are very warp-resistant.

Another advantageous embodiment of the invention consists in that the support part is formed by two further plates that are aligned parallel to one another and are connected together, and between which two further plates the first pivot lever and the second pivot lever are disposed, and wherein the mutual spacing of the two further plates is so big that the two first plates come to lie in each case between the two further plates. Also this design of the support part further improves the stability.

Preferably, mountable on the two further plates on the outside are connecting elements in which the storage compartments can be hung. The most diverse embodiments of storage compartments can thereby be used, depending upon need, for example shelves, trays, baskets, etc.

Preferably, a spring element is provided which, on the one hand, is coupled to one of the two pivot levers at a pivot point, and, on the other hand, is held on the rod-shaped support. The weight of the cupboard installation part with the storage compartments and the items disposed thereon can thereby be compensated so that a user, who would like to move the cupboard installation part out of the upper cupboard or bring it into the moved-in position, does not have to exert too much force.

Preferably, the coupling point of the spring element is disposed in a way displaceable in the longitudinal direction of the pivot lever, and displacement means are provided for moving and locking of the coupling point. The acting spring force thereby allows itself to be adapted to the weight of the cupboard installation part with the storage compartments and the items disposed thereon.

Another advantageous embodiment of the invention consists in that coupled to the rod-shaped support is the one end of a damping element, the other end of which is coupled to one of the two pivot levers. Thereby prevented is that, with too great or too weak a spring force, the cupboard installation part reaches, with too great speed, the moved-out or moved-in position with a thud when the user has let go of it.

An operating handle is preferably provided on the support part, making it easier for a person to use.

A further advantageous embodiment of the invention consists in that the pivoting in and out of the cupboard installation part into and out of the upper cupboard takes place in a motor-driven way. Instead of the damping element, a linear actuator, controllable electrically via push button, could be provided for this purpose.

An embodiment of the invention will be explained more closely in the following, by way of example, with reference to the attached drawing.

Figure 1:
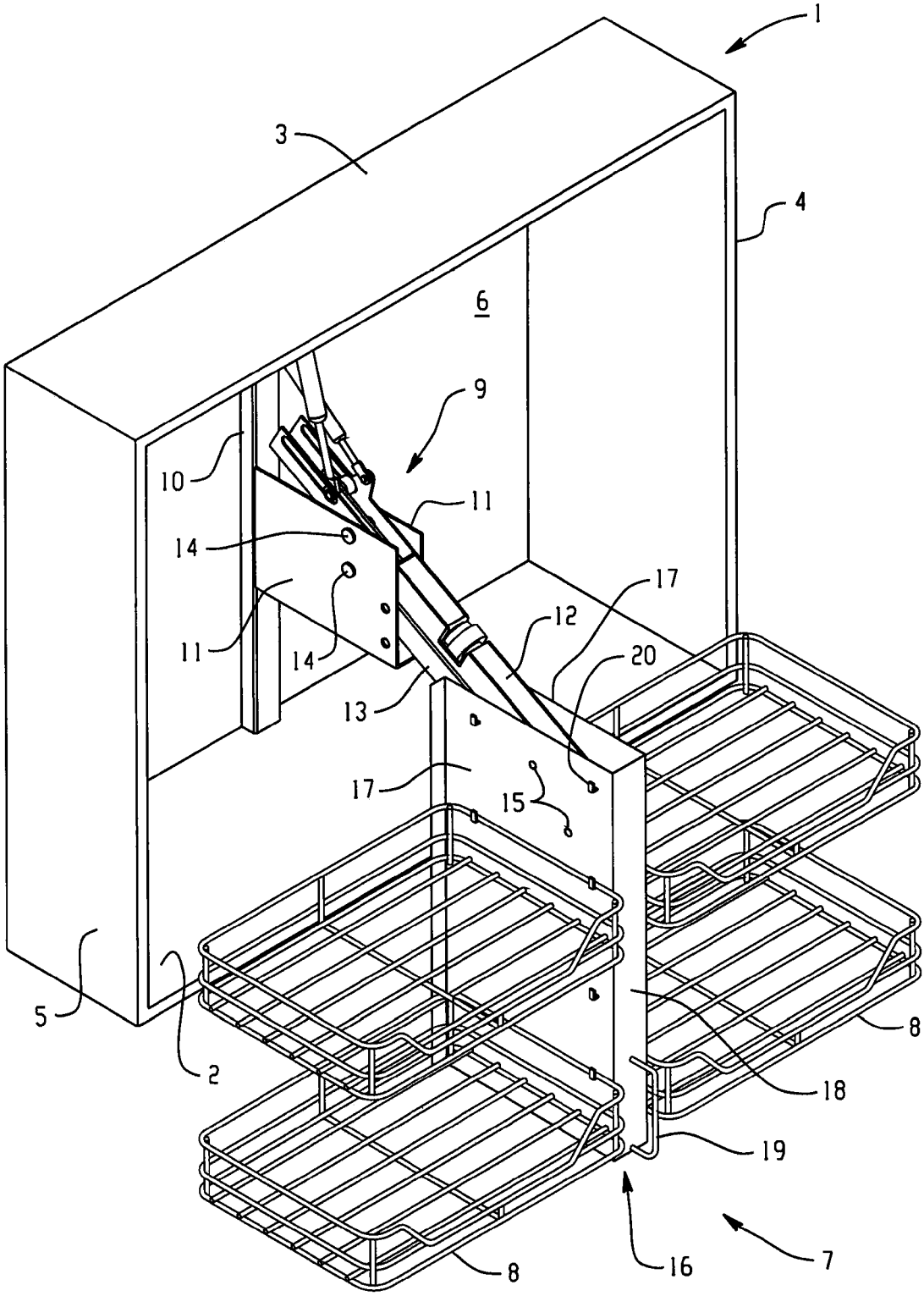
FIG. 1 shows, in a three-dimensional representation, a schematically depicted upper cupboard with inserted cupboard installation part with storage compartments, in the moved-out and downwardly displaced position.
Figure 2:
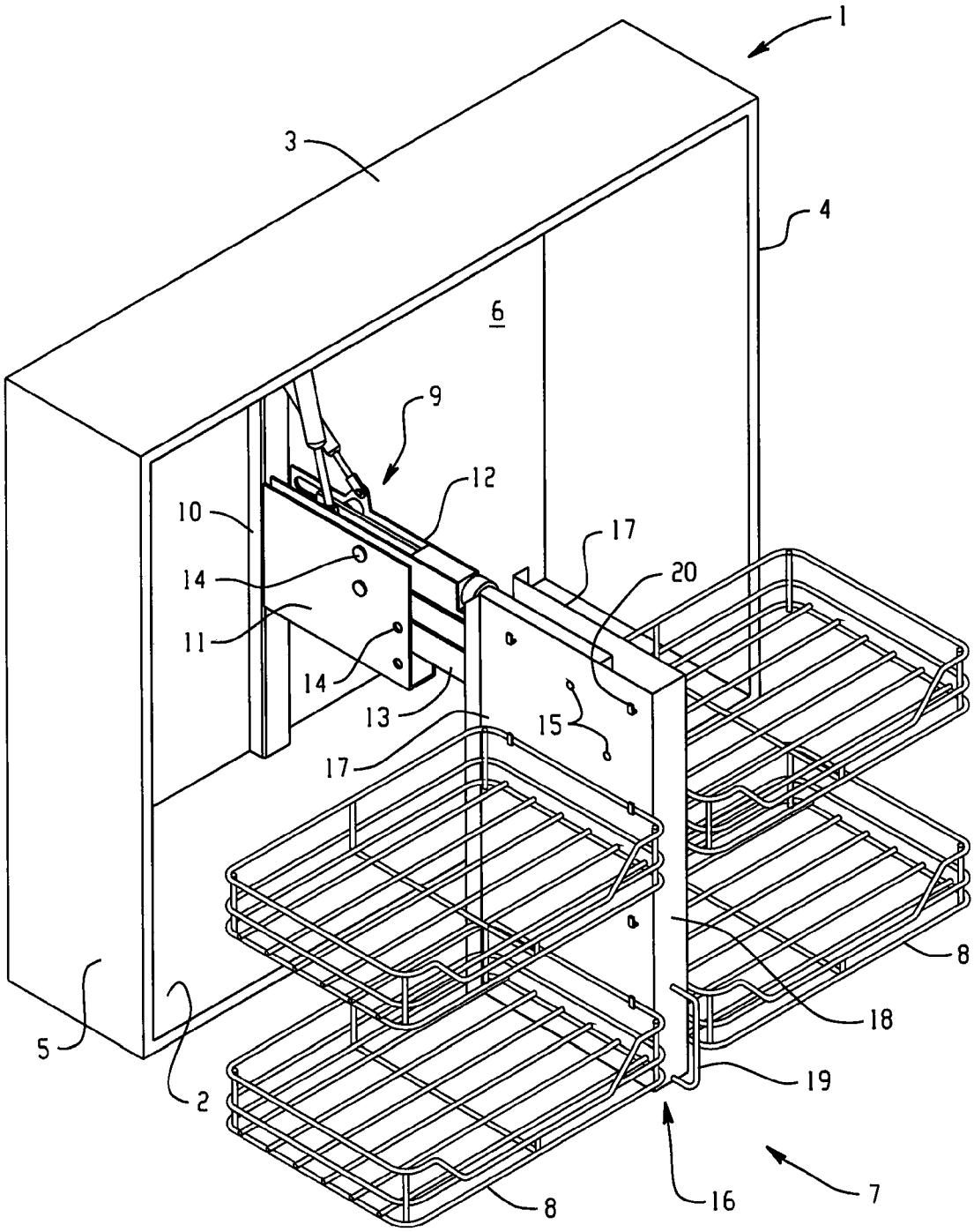
FIG. 2 shows, in a three-dimensional representation, the cupboard installation part with storage compartments according to FIG. 1 during moving into the upper cupboard.
Figure 3:
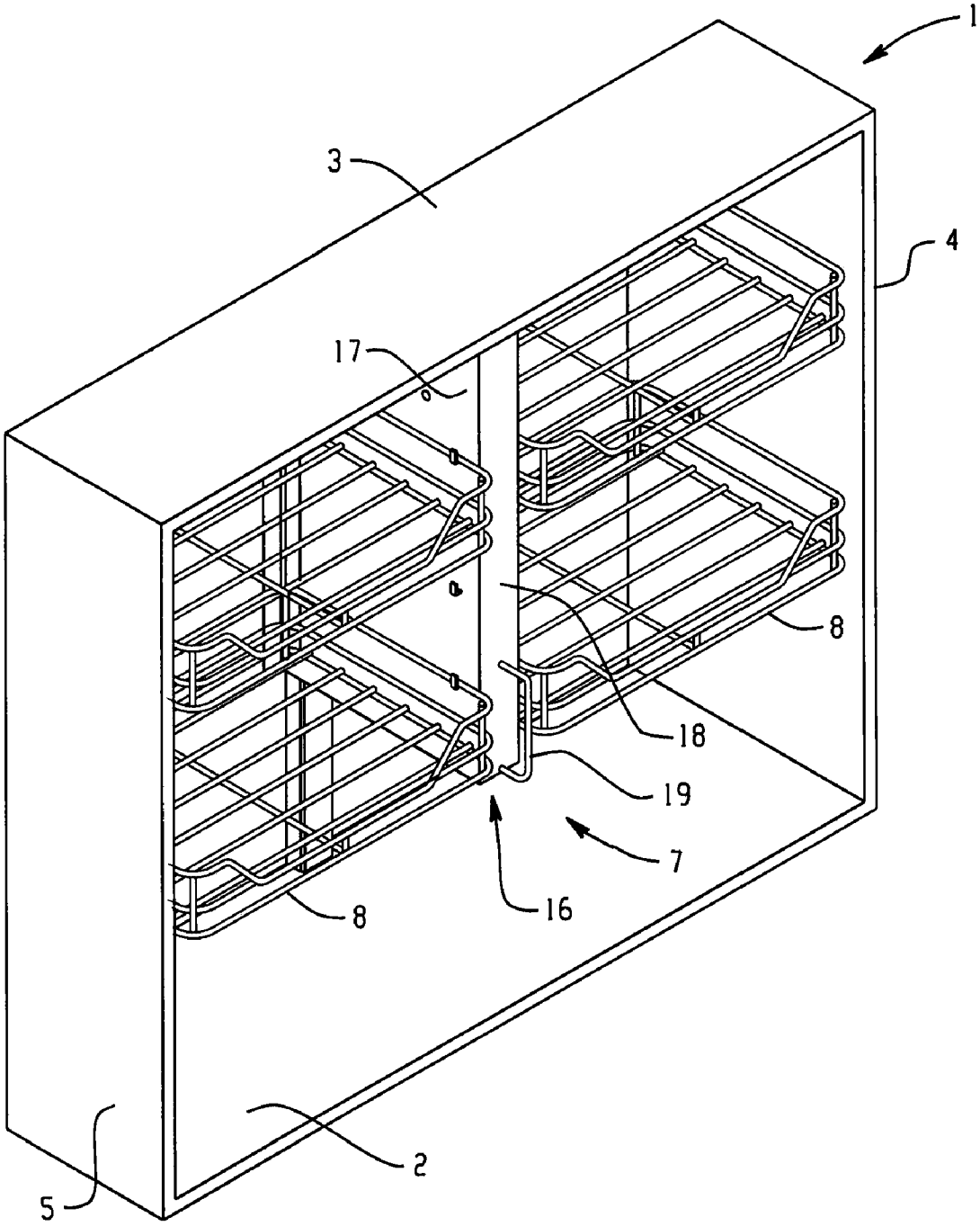
FIG. 3 shows, in a three-dimensional representation, the cupboard installation part with storage compartments according to FIG. 1, in the position of being completely moved into the upper cupboard.

Shown schematically in FIGS. 1 to 3 is an upper cupboard 1, as is used in kitchens, for example. This upper cupboard consists in a known way of a floor 2, an upper cover 3, two lateral walls 4 and 5 and a rear wall 6. For purposes of clarity, the front cover has been omitted, which can consist of two pivotable doors, for example.

Inserted into this upper cupboard is a cupboard installation part 7 that is provided with storage compartments 8. In this embodiment example, these storage compartments 8 consist of baskets; of course other storage compartments, for instance trays or shelves, are also conceivable.

The cupboard installation part 7 comprises a supporting element 9, which is inserted and mounted in the upper cupboard 1. The supporting element 9 has a rod-shaped support 10, which is attached to the floor 2 and to the upper cover 3 of the upper cupboard, as will still be seen in detail later on. Attached to this support 10 are two first plates 11, aligned parallel to one another. Disposed between these two first plates 11 are a first pivot lever 12 and a second pivot lever 13. This first pivot lever 12 and the second pivot lever 13 are each pivotably borne in a first pivot bearing 14 between the two first plates 11.

Coupled to the first pivot lever 12 and to the second pivot lever 13, in each case via a second pivot bearing 15, is a support part 16, whereby a pivotable connection is obtained. This support part 16 is formed by two further plates 17, which are aligned parallel to one another and are connected together via a crosspiece 18. Also with this support part 16, the first pivot lever 12 and the second pivot lever 13 are disposed between the two further plates 17. These two further plates 17 have a mutual spacing from one another which is so big that the two first plates 11 of the supporting element 9 find room between these further plates 17.

Installed on the two further plates 17 on the outside are connecting elements 20, on which the storage compartments 8 can be hung on both sides, at different heights.

The two first pivot bearings 14 and the two second pivot bearings 15, via which the first pivot lever 12 and the second pivot lever 13 are pivotably held on the supporting element 9 or respectively on the support part 16, form the vertices of a parallelogram. The support part 16 with the storage compartments 8 installed thereon can thereby be pivoted parallel from a position moved out of the upper cupboard 1 and displaced downward, as shown in FIG. 1, into a position moved into the upper cupboard 1, as shown in FIG. 3, an intermediate position being passed through, as shown in FIG. 2. Here the first pivot lever 12 and the second pivot lever 13 are each formed by a rectangular section, whereby the bearings between the two first plates 11 and the two further plates 17 are designed in a very stable way. Through the use of rectangular sections an optimal warp-resistance of the whole system is also obtained. Attached to the crosspiece 18, via which the further plates 17 are connected together, is an operating handle 19, via which a user can bring the support part 16 into the respective desired position.

Shown in FIGS. 1 to 3 is an embodiment in which the cupboard installation part 7 is disposed in the upper cupboard 1 in a central region. Storage compartments 8 having the same length can thereby be hung on the support part 16 on both sides. Of course it is also conceivable, however, for the cupboard installation part 7 to be installed in the immediate vicinity of a lateral wall, for example; then storage compartments 8 can be hung on the support part 16 on one side only. The cupboard installation part 7 can also be attached in a lateral region in the upper cupboard 1, so that narrow storage compartments can be hung on the support part 16 on the one side, while on the other side wider storage compartments can be hung on the support part 16. One is very flexible here. Through selection of the width of the storage compartments 8, the available space in the upper cupboard 1 can be made use of optimally. Contributing to this optimal use of space is also the minimal width of the cupboard installation part 7. With the known cupboard installation parts of this kind, as already described in the foregoing, bearings on both sides with the corresponding pivot levers are used, the space requirement owing to these bearing elements being practically twice as big as with the present solution according to the invention.

Figure 4:
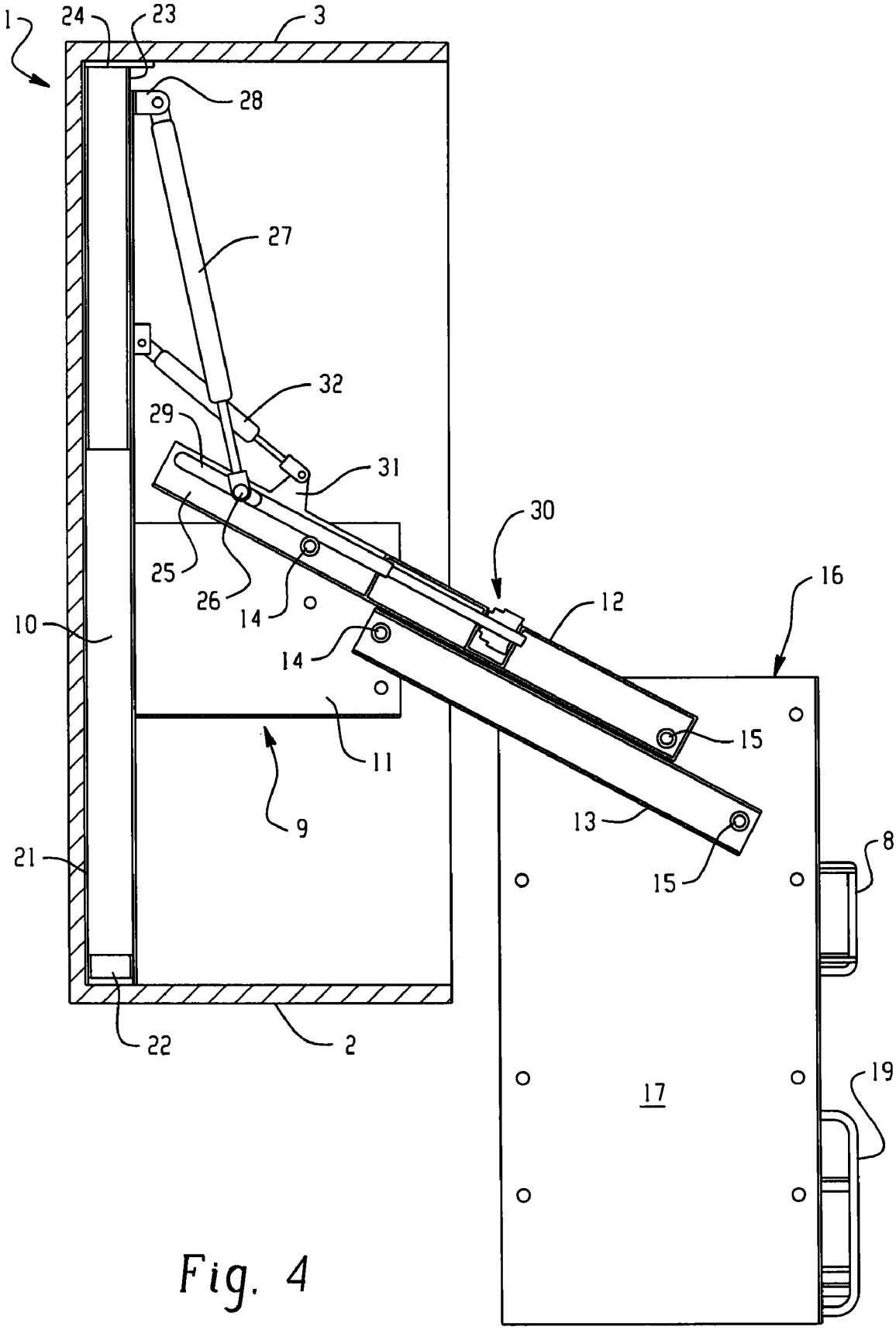
FIG. 4 shows a sectional view through the cupboard installation part according to the invention, in completely moved-out position.
Figure 5:
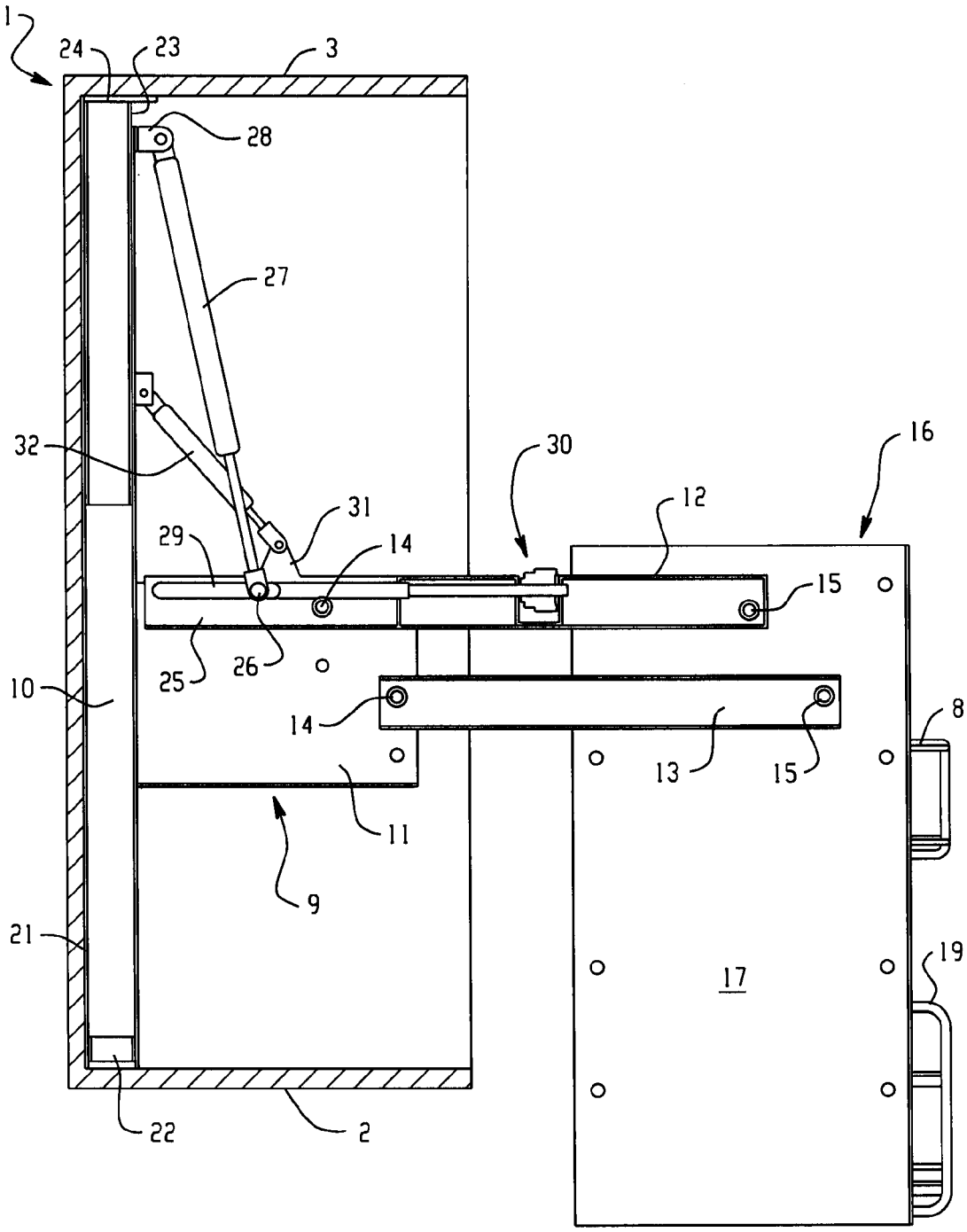
FIG. 5 shows a sectional view of the cupboard installation part according to FIG. 4, in an intermediate position.
Figure 6:
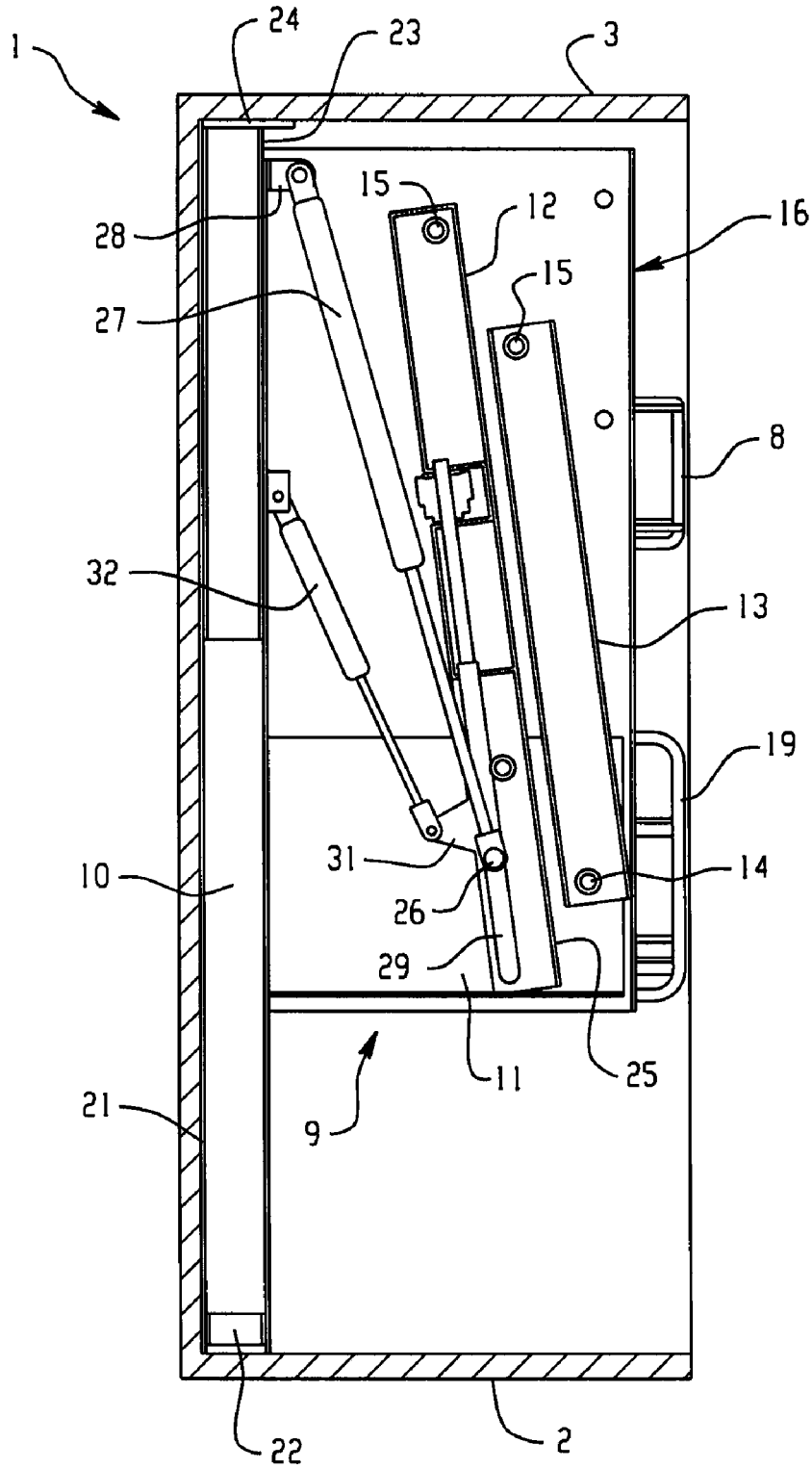
FIG. 6 shows a sectional view of the cupboard installation part according to FIG. 4, in the position of being completely moved into the upper cupboard.

As can be seen from FIGS. 4 to 6, the rod-shaped support 10 of the supporting element 9 consists of a first hollow section 21, which is designed as a rectangular hollow section (RHS). Disposed on the lower side of this hollow section 21 is a fastening plate, by means of which this hollow section 21 can be tightly screwed in a known way to the floor 2 of the upper cupboard 1. A further section 23 is inserted telescopically into the hollow section 21 from the other side. This further section 23 is likewise provided with a fastening plate 24 on the outside, which is attached to the upper cover 3 of the upper cupboard 1 by screwing. Through the possibility of displacement of the further section 23 in the hollow section 21, the rod-shaped support 10 thus allows itself to be adapted to the respective height of the upper cupboard 1. The further section 23 can then be fixed with respect to the hollow section 21, for example through set screws, in a known way.

Attached to the hollow section 21 of the rod-shaped support 10 are the first plates 11; the first pivot lever 12 and the second pivot lever 13 are pivotably borne in these first plates 11, in each case via a first pivot bearing 14. Via the second pivot bearings 15, the first pivot lever 12 and the second pivot lever 13 are pivotably coupled to the further plates 17, which further plates 17 form the support part 16.

In FIG. 4, the support part 16 is shown in the position of being moved out of the upper cupboard and displaced downward. This position is then reached when the first pivot lever 12 and the second pivot lever 13 abut each other. A stop is thereby formed for the lower position.

The first pivot lever 12 is provided with an extension 25, which projects beyond the first pivot bearing 14. Provided in this extension 25 is a coupling point 26, via which a spring element 27 is connected to the extension 25 of the first pivot lever 12 in an articulated way. The other end of the spring element 27 is coupled to a bracket 28, which is attached to the hollow section 21 of the rod-shaped support 10. With this spring element 27, which acts as compression spring, the weight of the support part 16 with the storage compartments 8 and the items accommodated thereon can be compensated. For setting the force acting upon the first pivot lever 12, the coupling point 26 allows itself to be shifted, via displacement means 30, in a longitudinal slot 29 provided in the extension 25, as will still be described later on.

Coupled to a projection 31 provided on the extension 25 is the one end of a damping element 32, whose other end is coupled to the hollow section 21 of the rod-shaped support 10. Achieved with this damping element 32 is that the pivoting-in movement and the pivoting-out movement of the support part 16 into the upper cupboard 1 or out of the upper cupboard 1 takes place in a damped way, so that the support part 16 does not shoot into one of the two positions as a result of the effect of the spring element 27.

As has already been mentioned, FIG. 4 shows the support part 16 in the position of being completely moved out of the upper cupboard 1 and displaced downward. FIG. 5 shows an intermediate position during the pivoting in of the support part 16 from the pivoted-out position according to FIG. 4 into the position of being pivoted into the upper cupboard 1. FIG. 6 shows the support part 16 in the state of being pivoted into the upper cupboard 1. It would also be conceivable to motorize this pivoting-in and pivoting-out operation by means of an electric linear actuator; this actuator could be disposed in a known way between the first pivot lever 12 and the second pivot lever 13, for example. This linear actuator could then be activated via push button, likewise in a known way.

Figure 7:
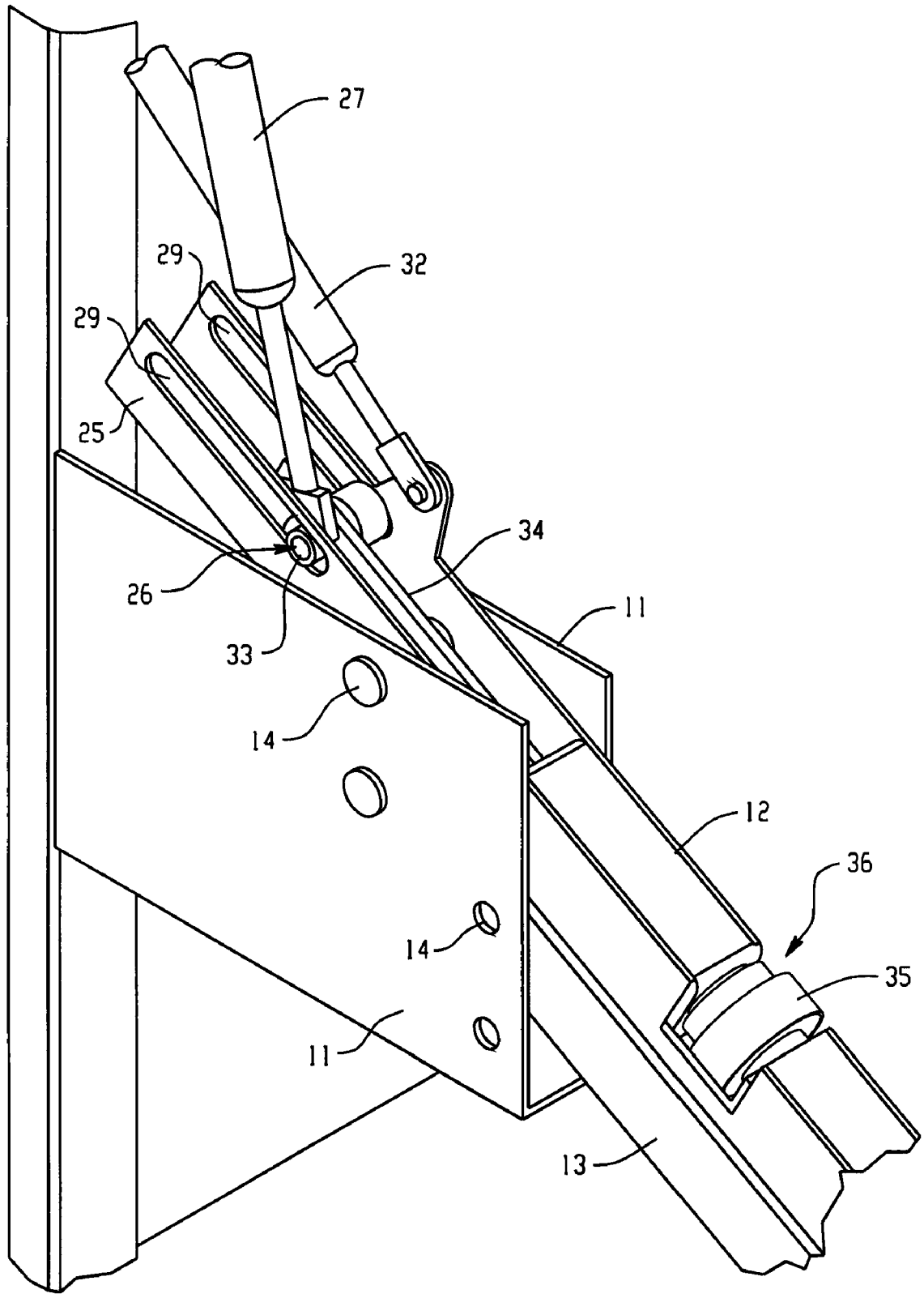
FIG. 7 shows, in a three-dimensional representation, a detail of the cupboard installation part, in which the displacement means are visible for displacement of the coupling point of the spring element.

Shown enlarged in FIG. 7 is the bearing of the first pivot lever 12 and of the second pivot lever 13, in each case in first pivot bearings 14, in the first plates 11 of the supporting element 9. As has already been mentioned, a longitudinal slot 29 is disposed on each side in the extension 25 of the first pivot lever 12. Displaceably borne in these longitudinal slots 29 is a pivot pin 33, which pivot pin 33 forms at the same time the coupling point 26 for the spring element 27 in the first pivot lever 12. This pivot pin 33 penetrates a slide rod 34, which is provided with a threaded part (not visible), that penetrates a set screw 35 which is disposed in a pocket 36 in the first pivot lever 12 in a non-displaceable way. By turning the set screw 35, the slide rod 34 can be shifted in longitudinal direction via the threaded part (not shown), whereby the pivot pin 33 likewise shifts in the longitudinal slot 29, and the coupling point 26 for the spring element 27 thus allows itself to be adjusted. The lever length between coupling point 26 and first pivot bearing 14 can thereby be changed, whereby the force of the spring element 27 acting upon the support part 16 can be adapted to the respective weight. The pivoting in and out of the support part 16 into the upper cupboard, or respectively out of the upper cupboard, is thereby facilitated for the respective user.

With this solution according to the invention, a cupboard installation part is obtained that has a very stable construction, is easily mountable in an upper cupboard, and can be used in a very flexible way. Moreover this cupboard installation part requires very little space, and it can be fitted with diverse storage compartments.

The invention claimed is:

1. A cupboard installation part (7) with storage compartments (8), which part (7) is insertable in an upper cupboard (1) and is pivotable from an upper position, moved into the upper cupboard (1), into a position moved out of the upper cupboard (1) and displaced downward, for which purpose the cupboard installation part (7) comprises first and second pivot levers (12, 13) aligned parallel, which, on the one hand, are coupled to the cupboard installation part (7), and, on the other hand, are able to be coupled to a supporting element (9) insertable and attachable in the upper cupboard (1), on which supporting element (9) the first pivot lever (12) and the second pivot lever (13) are each pivotably supported by a first pivot bearing (14), which are each pivotably connected via a second pivot bearing (15) to a support part (16), characterised in that the supporting element (9) has a rod-shaped support (10) on which rod-shaped support (10) two first plates (11), aligned parallel to each other, are installed, between which two first plates (11) the first pivot lever (12) and the second pivot lever (13) are disposed, in that the support part (16) is formed by two second plates (17), which are aligned parallel to each other and are connected to each other, and between which two second plates (17) the first pivot lever (12) and the second pivot lever (13) are disposed, and in that the storage compartments (8) are able to be installed on the support part (16) externally at least on one of the second plates (17).

2. A cupboard installation part according to claim 1, characterised in that the rod-shaped support is provided on one side with a fastening plate (22), into which support (10) a section (23) is telescopically insertable on the other side, on whose outer end a fastening plate (24) is also disposed, and which section (23) is able to be fixed in any position with respect to the rod-shaped support (10).

3. A cupboard installation part according to claim 2, characterised in that a spring element (27) is attached which, on the one hand, is coupled at a pivot point or coupling point to one of the two pivot levers (12, 13), and, on the other hand, is held on the rod-shaped support (10).

4. A cupboard installation part according to claim 3, characterised in that the pivot point or coupling point (26) of the spring element (27) is disposed in a way displaceable in the longitudinal direction of the pivot lever (12, 13), and displacement means (30) are provided for moving and locking of the pivot point or coupling point (26).

5. A cupboard installation part according to claim 2, characterised in that coupled to the rod-shaped support (10) is the one end of a damping element (32), whose other end is coupled to one of the two pivot levers (12, 13).

6. A cupboard installation part according to claim 1, characterised in that the first pivot lever (12) and the second pivot lever (13) are formed by hollow sections.

7. A cupboard installation part according to claim 1, characterised in that the mutual spacing of the two second plates (17) is so big that the two first plates (11) come to lie between the two second plates (17).

8. A cupboard installation part according to claim 1, characterised in that connecting elements (20) for receiving storage compartments (8) are mountable on the two second plates (17) on the outside.

9. A cupboard installation part according to claim 1, characterised in that an operating handle (19) is provided on the support part (16).

10. A cupboard installation part according to claim 1, characterised in that the pivoting in and out of the cupboard installation part (7) into and out of the upper cupboard (1) takes place in a motor-driven way.

* * * * *